US008439634B1

(12) United States Patent
Liang

(10) Patent No.: US 8,439,634 B1
(45) Date of Patent: May 14, 2013

(54) BOAS WITH COOLED SINUSOIDAL SHAPED GROOVES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 377 days.

(21) Appl. No.: 13/011,234

(22) Filed: Jan. 21, 2011

(51) Int. Cl.
*F01D 5/20* (2006.01)

(52) U.S. Cl.
USPC ..... 415/173.1; 415/115; 415/116; 415/170.1; 416/97 R

(58) Field of Classification Search ..... 415/115, 415/116, 170.1, 173.1, 173.2, 173.5; 416/95, 416/96 R, 97 R
See application file for complete search history.

(56) References Cited

U.S. PATENT DOCUMENTS 3,365,172 A * 1/1968 Howald et al. ..... 415/117
6,155,778 A * 12/2000 Lee et al. ..... 415/116
7,665,961 B2 * 2/2010 Lutjen et al. ..... 415/173.1

* cited by examiner

*Primary Examiner* — Fenn Mathew
*Assistant Examiner* — Michael Sehn
(74) *Attorney, Agent, or Firm* — John Ryznic

(57) ABSTRACT

A BOAS with a blade tip shroud having rows of sinusoidal shaped grooves on a bottom side, each groove having a row of thin slots extending along the aft side of the groove and opening into the groove, and each thin slot connected to a plurality of metering holes that open into a cooling air supply cavity formed on the top surface of the tip shroud.

4 Claims, 3 Drawing Sheets

BOAS WITH COOLED SINUSOIDAL SHAPED GROOVES

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to an air cooled blade outer air seal (BOAS) with cooled grooves for an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A row or stage of turbine rotor blades rotate within an annular arrangement of ring segments in which blade tips form a small gap with an inner or hot surface of each ring segment. The size of the gap changes due to different thermal properties of the blade and the BOAS or ring segments from a cold state to a hot state of the turbine. The smaller the gap, the less hot gas leakage will flow between the blade tips and the ring segments.

An IGT engine operates for long periods of time at steady state conditions, as opposed to an aero gas turbine engine that operates for only a few hours before shutting down. Thus, the parts in the IGT engine must be designed for normal operation for these long periods, such as up to 40,000 hours of operation at steady state conditions.

High temperature turbine blade tip shroud heat load is a function of the blade tip section leakage flow. A high leakage flow will induce a high heat load on the blade tip shroud. Therefore, blade tip shroud cooling and sealing issues must be considered as a single problem. Prior art grooved turbine blade tip shroud includes a number of grooves opening from an underside surface of the tip shroud at from 90 to 130 degrees angle relative to the tip shroud backing structure in which the grooves extends into the flow path for the entire axial length of the blade outer air seal. The main purpose for incorporating grooved tip shroud in a blade design is to reduce the blade tip leakage and to provide for rubbing capability fro the blade tips. Prior art grooved blade tip shrouds used in the turbine design form straight teeth and are not cooled.

FIG. 1 shows a prior art turbine with a tip shroud cooling design. The blade tip shroud 11 includes film cooling holes that discharge cooling air from an impingement cavity 13 located between the tip shroud 11 and an impingement plate 14 that has impingement 15 holes spaced about it. During engine operation, the film cooling holes will be smeared when the blade tips rub into the tip shroud. Smearing of the film holes results in plugging of significantly reducing the cooling air flow to the tip shroud, and therefore reduces the cooling effectiveness of the tip shroud. An over-metal temperature will occur and the hot spots will cause erosion and shorten the part life of the engine. This is especially a problem in aero engines because the blade tip shroud is relatively small (when compared to an IGT engine) so that the film cooling holes are very small.

BRIEF SUMMARY OF THE INVENTION

The blade tip leakage flow and cooling issues of the above described prior art blade tip shroud can be alleviated with the blade tip shroud cooling circuit of the present invention in which the tip shroud includes a number of rows of sinusoidal shaped grooves opening onto the hot bottom side, and in which each groove forms a vortex flow recirculation groove, and in which each groove includes a row of inlet metering holes connected to small thin slots that open into the sinusoidal grooves to inject impingement cooling air into the grooves and produce a recirculation flow pattern within the grooves. The cooling holes are located away from the groove openings so that blade tip rubbing will not block the cooling hole openings.

DETAILED DESCRIPTION OF THE INVENTION

Figure 1:
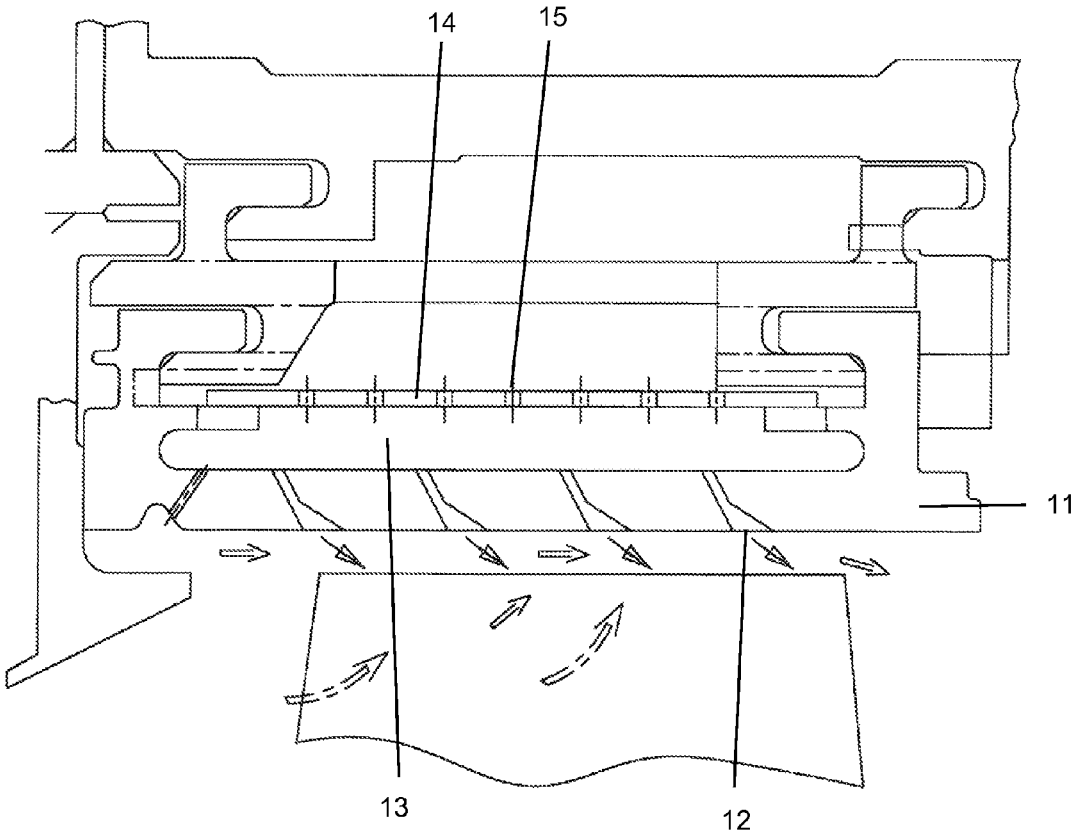
Fig 1 prior art
FIG. 1 shows a cross-sectional view of a prior art turbine blade tip shroud design with film cooling holes.
Figure 2:
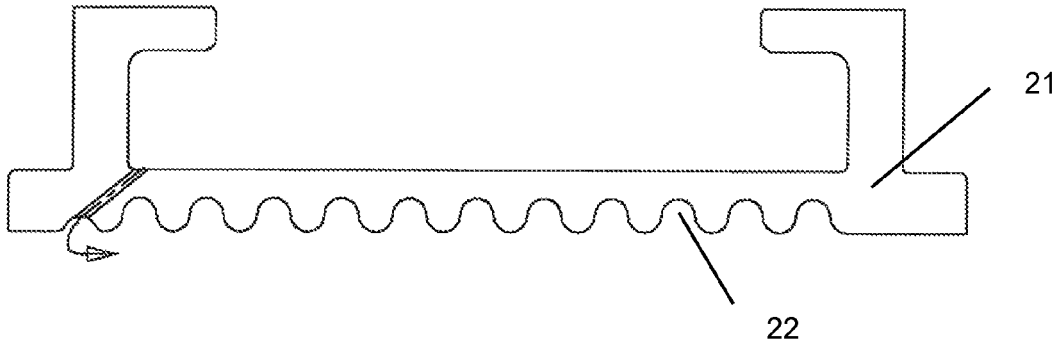
FIG. 2 shows a cross-sectional view of the blade tip shroud of the present invention with the sinusoidal shaped grooves.

The turbine blade tip shroud of the present invention is in FIG. 2 and includes the blade tip shroud 21 with a cooling supply cavity formed above it and row of circumferential grooves 22 opening onto the bottom or hot side. The circumferential grooves 22 have a sinusoidal cross sectional shape when looking at the side in the circumferential direction of the turbine.

Figure 3:
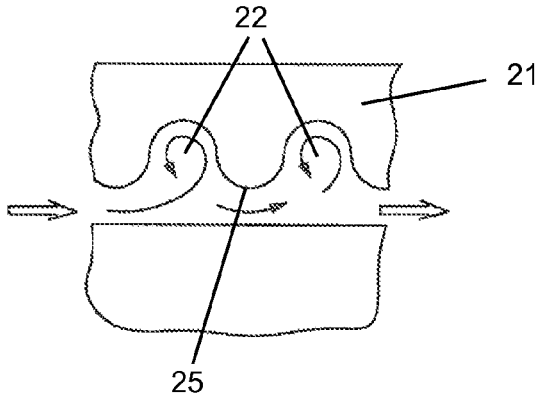
FIG. 3 shows a detailed cross-sectional view of some of the sinusoidal shaped grooves and the blade tip shroud with the leakage flow recirculation pattern of the present invention.

The sinusoidal shaped grooves 22 produce a recirculation flow of the hot gas leakage across the blade tip gap when cooling air is injected into each of the grooves as represented by the arrows in FIG. 3. A low point on the grooves 25 forms a surface for the blade tips to rub against the tip shroud 21 without blocking or plugging any cooling holes. The sinusoidal grooves have concave sides and convex sides in which the convex sides form the small gap with the blade tip while the concave sides form the top of the recirculation space in the groove.

Figure 4:
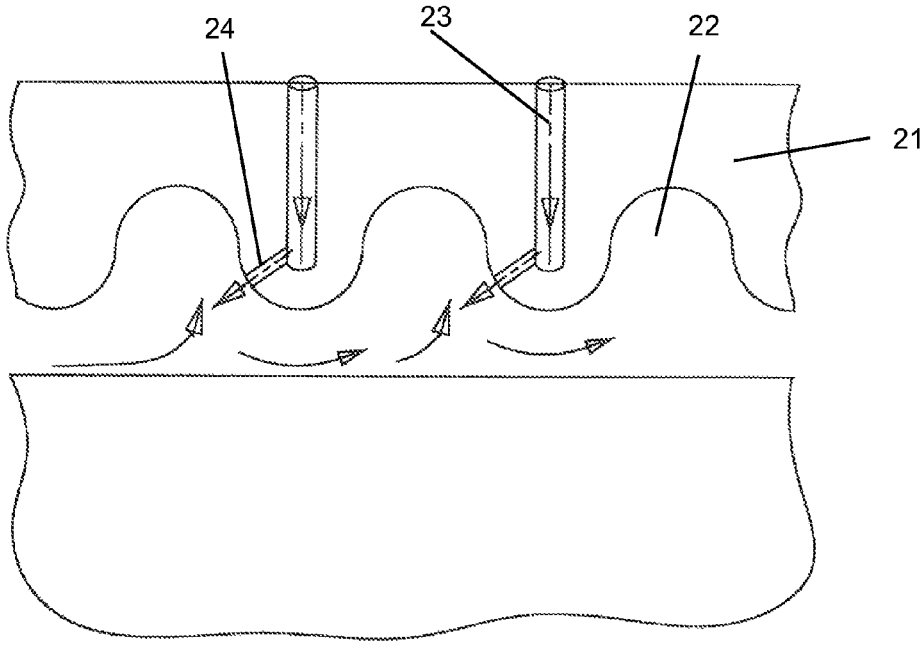
FIG. 4 shows a detailed cross-sectional view of some of the sinusoidal shaped grooves and the blade tip shroud with the metering holes connected to the small thin slots of the present invention.
Figure 5:
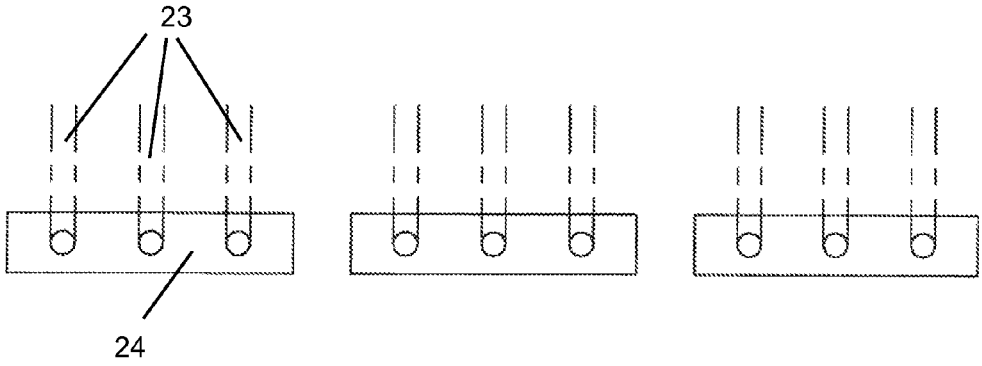
FIG. 5 shows a view of a row of the thin slots opening into the sinusoidal groove with three metering holes connected to each of the thin slots.

FIG. 4 shows a section of the blade tip shroud with the grooves 22 in which each groove includes a row of inlet metering holes 23 that are connected to individual small thin slots 24 that open into the grooves 22. The slots 24 are directed to discharge the cooling air into the groove 22 on a downstream side (in the direction of the leakage flow through the blade tip gap). The slots 24 are also angled from the axis of the inlet metering holes 23 so that impingement cooling of the tip shroud 21 will also occur. FIG. 5 shows a different angle view of the groove with a row of the thin slots 24 opening into the groove on the downstream or aft wall of the groove. The thin slots 24 extend along the groove from the front to the back end and are not continuous because of structural issues. Each thin slot is much wider than the height, and thus the reference to a thin slot. Each slot is connected to several of the metering holes 23 in order to supply enough cooling air to the thin slot to produce the desired cooling and flow affect within the groove 22.

Cooling air is supplied through the blade ring carrier and then impinged on the back side surface of the blade tip shroud 21. The spent impingement cooling air then flows through the inlet metering holes and into the slots where the cooling air is diffused before discharging into the grooves 22. A high velocity of jet air flows against the in-coming hot gas leakage created within the grooves 22. The inlet metering holes 23 and cooling air slots 24 provide both cooling and sealing for the blade tip shroud surface.

The multiple metering and diffusion cooling passages can be designed based on the airfoil gas side pressure distribution in both the axial and circumferential directions of the tip shroud independently of one another. In addition, each individual metering and diffusion passage can be based on the tip shroud local external heat load to achieve a desired local metal temperature. This can be achieved by varying the cooling air flow rate, the hole size and the different pressure ratios across the cooling air inlet metering holes.

The spent cooling air discharged from the metering and diffusion slots and into the grooves creates a backward flow against the on-coming hot gas streamwise leakage flow to produce a recirculation flow pattern within the blade tip shroud grooves. The interaction of the blade tip leakage flow and the spent cooling air is to push the leakage flow from the upstream side of the groove to the downstream side. This also creates an aerodynamic air curtain that functions to block the blade tip leakage flow. In addition to the counter flow pattern, the sinusoidal shaped grooves with the rounded sides will force the secondary flow to accelerate through a narrow tip leakage passage and yield a smaller vena contractor that therefore will reduce the effective leakage flow area between the blade tip and the tip shroud. The series of smaller vena contractors yields a very effective accumulated leakage flow reduction that reduces the blade tip leakage flow. Use of the sinusoidal shaped grooves will also retain the spent cooling air from the metering and diffusion slots within the grooves for a longer period of time than in the prior art and therefore results in a better utilization of the cooling air. The tip section will allow for the blade tip to rub into the tip shroud at smaller contact surfaces and without plugging the cooling holes.

Major advantages of the blade tip shroud sealing and cooling air ejection design of the present invention over the prior art BOAS cooling design are described below. The blade tip shroud geometry and cooling air ejection induces a very effective blade cooling and sealing for the blade tip shroud. The blade tip shroud cooling utilizes a series of metering and diffusion passages to provide convection cooling for the tip shroud first, and then discharges the spent cooling air into the circumferential sinusoidal shaped grooves for additional film cooling and sealing on the blade tip shroud external hot surface. The blade tip shroud circular circumferential grooves reduce the hot gas side convection heat load area and generate more cooling side convection surface area which will enhance the blade tip shroud cooling capability. Near-wall circumferential cooling grooves used for the blade tip shroud reduces the conduction thickness and increases the tip shroud overall heat transfer convection capability and thus reduces the blade tip shroud metal temperature. The tip shroud cooling circuit increases the design flexibility to re-distribute the cooling air flow and/or add cooling air flow for each of the metering and diffusion cooling passages, and therefore increases the growth potential for this cooling air design for future turbines. Each individual metering and diffusion cooling passage can be independently designed based on the local heat load and aerodynamic pressure loading conditions. A lower heat load on the BOAS components results in a lower demand for cooling air flow. Higher turbine efficiency is produced due to the low blade leakage flow and cooling air flow requirement. A reduction of the blade tip section heat load is produced due to the lower leakage flow which increases the tip shroud useful life. The spent impingement cooling air ejected into the on-coming hot gas leakage flow reduces the leakage flow across the blade tip gap. A narrow leakage flow gap at the rounded ends of the grooves creates a flow restriction for the hot gas leakage flow and thus recues the amount of leakage flow across the blade tip gap. The overall cooling design creates more convection cooling surface area within the grooves than the surface area of the external hot gas side heat load.

I claim the following:

1. A blade tip shroud for a turbine in a gas turbine engine, the blade tip shroud comprising:

an upper surface forming a cooling air supply cavity;

a bottom side having a row of sinusoidal shaped grooves extending along a circumferential direction of the turbine;

a row of thin slots extending along an aft side wall of the sinusoidal shaped grooves and opening into the grooves; and, a plurality of metering holes opening into each of the thin slots and connected to the cooling air supply cavity.

2. The blade tip shroud of claim 1, and further comprising:

the sinusoidal shaped grooves cover substantially the entire bottom side of the tip shroud.

3. The blade tip shroud of claim 1, and further comprising:

the metering holes are normal to the upper surface of the tip shroud; and, the thin slots extend at an angle from the metering holes.

4. The blade tip shroud of claim 3, and further comprising:

the row of thin slots opens into the groove at a location just upstream from a convex side of the grooves.

* * * * *